US009067448B2

(12) United States Patent
Dannhauser et al.

(10) Patent No.: US 9,067,448 B2
(45) Date of Patent: Jun. 30, 2015

(54) PRE-TREATMENT COMPOSITION FOR INKJET PRINTING

(75) Inventors: Thomas Joseph Dannhauser, Pittsford, NY (US); Yang Xiang, Dayton, OH (US); Raouf Botros, Centerville, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 522 days.

(21) Appl. No.: 13/462,067

(22) Filed: May 2, 2012

(65) Prior Publication Data

US 2013/0293647 A1 Nov. 7, 2013

(51) Int. Cl.

| | |
|---|---|
| ***B41M 5/52*** | (2006.01) |
| ***B41M 5/00*** | (2006.01) |
| ***B41M 5/50*** | (2006.01) |

(52) U.S. Cl.

CPC ..... *B41M 5/0017* (2013.01); *B41M 5/52* (2013.01); *B41M 5/502* (2013.01); *B41M 5/5218* (2013.01); *B41M 2205/40* (2013.01)

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00; B41M 7/0072; B41M 5/52; B41M 5/5218

USPC ..... 347/100, 95, 96, 101, 102, 105, 88, 99; 106/31.6, 31.13, 31.27; 523/160, 161; 428/195, 32.1

See application file for complete search history.

(56) References Cited

U.S. PATENT DOCUMENTS

| | | | | |
|---|---|---|---|---|
| 4,554,181 | A * | 11/1985 | Cousin et al. | 347/105 |
| 4,944,988 | A * | 7/1990 | Yasuda et al. | 347/105 |
| 5,474,843 | A | 12/1995 | Lambert et al. | |
| 5,536,627 | A | 7/1996 | Wang et al. | |
| 5,700,582 | A | 12/1997 | Sargeant et al. | |
| 5,770,353 | A | 6/1998 | Wang et al. | |
| 6,114,022 | A * | 9/2000 | Warner et al. | 347/105 |
| 6,156,384 | A * | 12/2000 | Hutter et al. | 427/288 |
| 6,207,258 | B1 | 3/2001 | Varnell | |
| 6,613,503 | B1 | 9/2003 | Isaac et al. | |
| 6,779,884 | B1 | 8/2004 | Ma et al. | |
| 7,041,338 | B2 | 5/2006 | Nigam | |
| 7,199,182 | B2 | 4/2007 | Tanaka et al. | |
| 8,092,873 | B2 | 1/2012 | Wang et al. | |
| 2003/0203134 | A1 * | 10/2003 | Sheng | 428/32.1 |
| 2009/0022910 | A1 * | 1/2009 | Teramae | 428/32.2 |
| 2011/0059272 | A1 | 3/2011 | Tran et al. | |
| 2011/0091666 | A1 | 4/2011 | Wang et al. | |
| 2011/0279554 | A1 * | 11/2011 | Dannhauser et al. | 347/106 |
| 2012/0034398 | A1 | 2/2012 | Wang et al. | |

* cited by examiner

*Primary Examiner* — Manish S Shah

(74) *Attorney, Agent, or Firm* — Andrew J. Anderson; Raymond L. Owens

(57) ABSTRACT

A coating composition for pre-treating a substrate prior to inkjet printing thereon, and an inkjet receiving medium including a substrate and having a topmost layer coated thereon, where the coating composition has a solids content which includes at least 30 wt % of one or more aqueous soluble salts of multivalent metal cations, and particles had primarily of polymer having a Rockwell Hardness of less than R90 and having a mode equivalent spherical diameter of at least about 2 micrometers. When coated, the composition provides at least 0.01 g/m$^2$ of particles included primarily of polymer having a Rockwell Hardness of less than R90 and which have an equivalent spherical diameter of i) at least about 2 micrometers and ii) at least 0.1 micrometer greater than the minimum coated thickness of the topmost layer.

18 Claims, No Drawings

PRE-TREATMENT COMPOSITION FOR INKJET PRINTING

FIELD OF THE INVENTION

The invention relates to the field of inkjet printing. In particular the invention relates to a composition to be applied to a receiver to enhance the quality of inkjet prints printed with pigment-based ink, to inkjet recording media treated with such composition, and to printing systems and methods using such media.

BACKGROUND OF THE INVENTION

The present invention is directed in part to overcoming the problem of printing on glossy or semi-glossy coated papers or the like with aqueous inkjet inks. Currently available coated papers of this kind have been engineered over the years to be compatible with conventional, analog printing technologies, such as offset lithography, and may be designated as "offset papers." The printing inks used in offset printing processes are typically very high solids, and the solvents are typically non-aqueous. As a consequence, the coatings that are currently used to produce glossy and semi-glossy offset printing papers, such as those used for magazines and mail order catalogs, have been intentionally designed to be resistant to the absorption of water. In fact, when these papers are characterized by standard tests as to their porosity and/or permeability, they have been found to be much less permeable than a typical uncoated paper.

In contrast to lithographic inks, inkjet inks are characterized by low viscosity, low solids, and aqueous solvent. When such coated offset papers are printed with inkjet inks that comprise as much as 90-95% water as the carrier solvent, the inks have a tendency to sit on the surface of the coating, rather than penetrate into the coating and/or underlying paper substrate.

Because the inks printed on a water-resistant receiver must dry primarily by evaporation of the water without any significant penetration or absorption of the water into the coating or paper, a number of problems are encountered. One such problem is that the individual ink droplets slowly spread laterally across the surface of the coating, eventually touching and coalescing with adjacent ink droplets. This gives rise to a visual image quality artifact known as "coalescence" or "puddling." Another problem encountered when inks dry too slowly is that when two different color inks are printed next to each other, such as when black text is highlighted or surrounded by yellow ink, the two colors tend to bleed into one another, resulting in a defect known as "intercolor bleed." Yet another problem is that when printing at high speed, either in a sheet fed printing process, or in a roll-to-roll printing process, the printed image is not dried sufficiently before the printed image comes in contact with an unprinted surface, and ink is transferred from the printed area to the unprinted surface, resulting in "ink retransfer."

In contrast to glossy offset papers, some coated papers for offset lithography have matte surfaces that are very porous. While high-solids lithographic inks remain on the surface, the colorant of aqueous inkjet inks on the other hand tends to absorb deeply into the paper, resulting in a substantial loss of optical density and as a consequence, reduced color gamut.

Recently high speed inkjet printing processes, including continuous inkjet printing processes, have been developed that are suitable for high speed, mid-volume printing and have become of interest to the commercial printing industry. As commercial offset papers are manufactured in high volume, it would be preferable to be able to use such offset papers themselves for commercial inkjet printing purposes, to take advantage of economies of scale. For the several reasons discussed above, however, the standard preparation of substrates for offset lithographic printing renders them unsuitable for printing with aqueous inkjet inks. Thus the need arises for inkjet-printable receivers providing the familiar look and feel as well as economical cost of standard lithographic printing-grade offset papers.

The requirements of commercial printing industry include, among others, image quality in terms of high optical density, broad color gamut, sharp detail, and minimal problems with coalescence, smearing, feathering and the like. Operationally, the printing process strives for low environmental impact, low energy consumption, fast drying, and so forth. The resulting print must exhibit durability, resisting abrasion when dry or if wetted.

Simply omitting the water-resistant coating of a glossy lithographic offset paper does not enable high-quality inkjet printing. Uncoated paper does not maintain the ink colorant at the surface, but allows significant penetration of the colorant into the interior of the paper, resulting in a loss of optical density and a low-quality image. Moreover, ink penetrates non-uniformly into the paper due to the heterogeneous nature of the paper, giving rise to mottle, which further degrades the image.

Very high quality photopapers have been developed for desktop consumer inkjet printing systems incorporating relatively high laydown ink-receiving layers that are porous and/or permeable to the ink. However, such coated photopapers are generally not suitable for high-speed commercial inkjet printing applications for a number of reasons. The thick coatings result in a basis weight that is impractically heavy for mailing or other bulk distribution means. Such receivers are not meant for rough handling or folding, which would result in cracking of the coated layers. In general, these coated photopapers are too expensive for high-speed inkjet commercial printing applications, such as magazines, brochures, catalogs, and the like. This is because such coated photopapers require either expensive materials, such as fumed oxides of silica or alumina, to produce a glossy surface or very thick coatings to adequately absorb the relatively heavy ink coverage required to print high quality photographs.

Multivalent metal salts are known to improve the print density and uniformity of images formed on plain papers from inkjet printers. For example, Cousin et al., in U.S. Pat. No. 4,554,181, disclose the combination of a water-soluble salt of a polyvalent metal ion and a cationic polymer at a combined dry coat weight of 0.1 to 15.0 g/m$^2$, for improving the print density of images printed by inkjet printers employing anionic dye-based inks.

Varnell, in U.S. Pat. No. 6,207,258, discloses the use of water-soluble salts of multivalent metal ions combined with a polymeric sizing agent and a carrier agent in a size press to improve the print density and uniformity of images formed on plain papers from inkjet printers employing pigment colorants in the ink set. The actual surface concentrations are not readily apparent from the disclosure of the size-press application method.

Tanaka, et al., in U.S. Pat. No. 7,199,182, disclose an inkjet recording material comprising an impervious substrate coated with at least 20 g/m$^2$ of an aqueous resin composition comprising a water soluble magnesium salt, an aqueous polyurethane, and one or more of a cationic compound (such as a cationic polymer), a nonionic water soluble high molecular weight compound (such as acetoacetylated poly(vinyl alcohol) (PVA acac)), and a water soluble epoxy compound.

Tran et al (US 2011/0059272) describe anti-curl compositions for inkjet receivers incorporating a water-soluble salt of a multivalent metal ion and a cationic polymer typically applied in the size press in combination with an amine oxide.

Sheng (US 2003/0203134) describes the use of a low friction substance to be a component of an inkjet receiving layer in order to modify the coefficient of friction of inkjet media and provide improved sheet feeding performance. The low friction substances are emulsified forms of waxes, simple organic polymers, silicone polymers, and fluoropolymers. The particle size is less than 5 micrometers, preferably less than 1 micrometer. The examples shown have slip aids present at approximately 4-5% of the total dry coat weight.

Ma et al. (U.S. Pat. No. 6,779,884) describes a system for printing durable inkjet images in which a slip component is applied over the previously printed inkjet image.

Wang et al. (US 2011/0091666) describes inkjet printable article in which the ink-receiving layer is comprised of 60-95% by weight clays, kaolin, calcium carbonate, or combinations of these particles.

Wang et al. (US 2012/0034398) and Wang et al. (U.S. Pat. No. 8,092,873) each describe an inkjet receptive coating layers comprising inorganic pigments as the major component by weight and a coefficient of friction reducing agent. The latter are described as having a particle size ranging from 0.1-2.0 micrometers, and are comprised of polyethylene, paraffin, carnauba, polypropylene, or PTFE waxes, or combinations of these.

Sargeant et al (U.S. Pat. No. 5,700,582) describes a polymer matrix coating for use as an inkjet receiver layer that avoids the problem of pigment ink cracking. The polymers chosen are characterized by Tg, an integrity value, and a swellability parameter. In addition, up to 15% by weight of the dry coating may be comprised of water-insoluble pigments. These particles may be comprised of organic materials including polyolefins, polystyrene, PTFE, and other materials.

In contrast to incorporating surface modifying chemistry at the size press during paper manufacturing, or coating of a relatively thick ink receiving layer on a photopaper, further coating treatments may also be applied as coatings on finished paper. Dannhauser et al (US 2011/0279554), e.g., describe an inkjet receiving medium including a substrate and having a topmost layer coated thereon comprising an aqueous soluble salt of a multivalent metal cation and a cross-linked hydrophilic polymer binder, for example acetoacetylated poly vinyl alcohol. Xiang and Botros (copending, commonly assigned U.S. Ser. No. 13/433,412) describes an inkjet receiving medium comprising a substrate and having a topmost layer coated thereon, wherein the topmost layer comprises one or more aqueous soluble salts of multivalent metal cations, a cationic polyelectrolyte comprising amidine moieties, and a second polymer which is distinct from the cationic polyelectrolyte comprising amidine moieties and which is selected from the group consisting of a polyamide-epichlorohydrin, a polyamine solution polymer, and a waterborne or water-dispersible polyurethane. Significant improvements in resistance to wet-rub and dry-rub defects may be achieved by use of such coatings on finished paper, along with good image quality, including high optical density and reduced mottle and coalescence.

Nigam, in U.S. Pat. No. 7,041,338 discloses a process of providing a coated paper by utilizing a coating composition containing one or more nitrogenous dye-fixing compound and a film forming binder, where the coating composition may also include an organic or inorganic cross-linker, and where the coating composition may be applied as a pretreatment (prior to printing), simultaneously with printing, or as an after-treatment.

Pigmented inks have many advantages over dye-based inks when they are printed on traditional paper designed for offset printing. It has been a challenge, however, to produce water resistant images with water-based pigmented inks so there will be no ink smearing when end-users turn the pages of a book with wet fingers or water is in contact with printed matter.

Even with the advances made to date in rub resistance, the need remains for more durable digital prints on offset paper to overcome the effects of handling in production and in use by the consumer.

SUMMARY OF THE INVENTION

It is a primary objective of one embodiment of this invention to enable the printing at high speed using aqueous inkjet inks, of glossy, semi-glossy and matte coated lithographic offset papers with high image quality, high optical density, and good physical durability, including resistance to wet or dry abrasion, water-fastness, and resistance to smearing from subsequent highlighter marking.

The present invention in one embodiment provides a coating composition for pre-treating a substrate prior to inkjet printing thereon, comprising one or more aqueous-soluble salts of multivalent metal cations, and particles comprised primarily of polymer having a Rockwell Hardness of less than R90, where the composition has a solids content which comprises at least 30 wt % of the one or more aqueous soluble salts of multivalent metal cations, and the particles comprised primarily of polymer having a Rockwell Hardness of less than R90 have a mode equivalent spherical diameter of at least about 2 micrometers.

In another embodiment, the present invention provides an inkjet receiving medium comprising a substrate and having a topmost layer coated thereon, wherein the topmost layer comprises one or more aqueous soluble salts of multivalent metal cations, and particles comprised primarily of polymer having a Rockwell Hardness of less than R90, where the topmost layer is coated at a dry solids coat weight of from 0.1 to 5 $g/m^2$ and comprises at least 30 wt % of the one or more aqueous soluble salts of multivalent metal cations, and provides at least 0.01 $g/m^2$ of particles comprised primarily of polymer having a Rockwell Hardness of less than R90 and which have an equivalent spherical diameter of i) at least about 2 micrometers and ii) at least 0.1 micrometer greater than the minimum coated thickness of the topmost layer.

Another aspect of the present invention is directed to a method of printing in which the above-described inkjet receiving medium is printed with an inkjet printer employing at least one pigment-based colorant in an aqueous ink composition, wherein the pigment-based colorant is stabilized using anionic dispersants or is self-dispersed.

In a further embodiment, the present invention provides a printing method comprising transporting an inkjet receiving medium of the invention by a continuous inkjet printhead applying an inkjet ink onto the receiving medium comprising at least one pigment based colorant in an aqueous ink composition, and subsequently transporting the printed receiving medium through a drying station.

Advantages of various embodiments of the invention include: high printed image quality including high pigment density and color gamut, and low grain and mottle; improved print durability to dry rub, wet abrasion, and highlighter marking; ability to provide all surface types including glossy, semi-glossy, and dull matte; and extremely low coverage allowing easy application and low cost.

DETAILED DESCRIPTION OF THE INVENTION

Inkjet receiving media in accordance with one embodiment of the invention comprise a substrate and have a preferably continuous topmost layer coated thereon, wherein the topmost layer comprises one or more aqueous soluble salts of multivalent metal cations, and at least 0.01 g/m$^2$ of particles comprised primarily of polymer having a Rockwell Hardness of less than R90 and which have an equivalent spherical diameter of at least about 2 micrometers. The topmost layer may further optionally comprise polymer binder, and the particles comprised primarily of polymer having a Rockwell Hardness of less than R90 and having an equivalent spherical diameter of at least about 2 micrometers further have an equivalent spherical diameter of at least 0.1 micrometer greater than the minimum coated thickness of the topmost layer, which minimum thickness will primarily be determined by the coated amount of any such binders contained in the topmost layer. More preferably, the particles comprised primarily of polymer having a Rockwell Hardness of less than R90 and having an equivalent spherical diameter of at least about 2 micrometers further have an equivalent spherical diameter of at least 0.5 micrometer greater than the minimum coated thickness of the topmost layer. The invention further relates to a coating composition for pre-treating a substrate prior to inkjet printing thereon to form such an inkjet receiving medium, comprising one or more aqueous-soluble salts of multivalent metal cations, and particles comprised primarily of polymer having a Rockwell Hardness of less than R90, where the composition has a solids content which comprises at least 30 wt % of the one or more aqueous soluble salts of multivalent metal cations, and the particles comprised primarily of polymer having a Rockwell Hardness of less than R90 have a mode equivalent spherical diameter of at least about 2 micrometers, preferably from about 2 to 10 micrometers.

The topmost layer may preferably be coated at dry solids coat weight of from 0.1 to 3 g/m$^2$, and preferably comprises from 30-98 wt % (more preferably from 50-90 wt %) of one or more aqueous soluble salts of multivalent metal cations, from about 1-69 wt % (more preferably 10-50 wt % of polymer binder, and from about 1 to 10 wt % particles comprised primarily of polymer having a Rockwell Hardness of less than R90, preferably less than R75, and having a mode equivalent spherical diameter of at least about 2 micrometers, preferably from about 2 to 10 micrometers. The particles comprised primarily of polymer having a Rockwell Hardness of less than R90 are further preferably coated in an amount of from 0.01 up to and including 0.05 grams/m$^2$, more preferably of from 0.02 up to and including 0.05 grams/m$^2$.

While the topmost layer of the receiving medium of the invention is believed to improve the inkjet printing performance on a wide variety of substrates, in a particular embodiment of the invention the substrate is one of a glossy, semi-glossy or matte coated lithographic offset paper. While such coated offset papers are designed for printing primarily with non-aqueous solvent-based inks, providing a topmost layer in accordance with the present invention over such coated offset papers has been found to enable inkjet printing with high image quality including reduced mottle, high optical density, and good physical durability, including resistance to wet or dry abrasion, water-fastness, and resistance to smearing from subsequent highlighter marking. Such embodiment employing a coated offset paper as the substrate of the inkjet receiving medium of the invention thus enables advantageous inkjet receiving mediums manufactured taking advantage of economies of scale in preparation of the medium substrate.

Lithographic coated offset papers typically comprise a paper base which has been coated with clay or the like and undergone surface calendering treatment to provide a desired surface smoothness. The invention applies to the use of both glossy and matte coated offset papers. Advantageously, the relatively low coating weight of the topmost layer of the inkjet receiving medium of the invention helps maintain the relative glossy or matte surface of the employed substrate. Such coated offset papers employable as the substrate of the inkjet receiving medium of the invention may be obtained from various commercial paper manufacturers, including, e.g., International Paper, Sappi, New Page, Appleton Coated, Abitibi—Bowater, Mohawk Papers, Verso, Mitsubishi, Norpac, Domtar, and many others. Specific examples include, e.g., STERLING ULTRA GLOSS paper (80 lb basis weight), a coated glossy offset paper for lithographic printing manufactured by NewPage, and UTOPIA BOOK (45 lb. basis weight), available from Appleton Coated, a coated matte offset paper.

In various embodiments, the substrate can be readily hydrophilic and capable of adsorbing and transferring ink colorant to the substrate interior prior to being coated thereon with the topmost layer of the invention, such as wherein the substrate may be porous. Alternatively, the substrate can be substantially impermeable to water or aqueous ink, such as a non-porous plastic film. In a particular preferred embodiment, the invention is particularly useful wherein the substrate comprises a relatively hydrophobic coated surface prior to being coated thereon with the topmost layer, and the topmost layer provides a continuous relatively hydrophilic surface.

While the invention is in certain embodiments directed towards the use of coated offset papers as the substrate, the topmost layer of the invention may also be used in combination with uncoated offset paper or other plain papers. Further, the invention may also be used with any of those supports usually used for inkjet receivers, such as resin-coated paper, polyesters, or microporous materials such as polyethylene polymer-containing material sold by PPG Industries, Inc., Pittsburgh, Pa. under the trade name of TESLIN, TYVEK synthetic paper (DuPont Corp.), and OPPALYTE films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates.

Biaxially oriented support laminates are described in U.S. Pat. Nos. 5,853,965, 5,866,282, 5,874,205, 5,888,643, 5,888,681, 5,888,683, and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The kind of paper supports listed above include a broad range of papers, from high end papers, such as photographic paper to low end papers, such as the kind used for newsprint. In a preferred embodiment, commercial offset-grade coated paper is used.

The topmost coating composition may be applied to both sides of the substrate, or alternatively to only one side. The method employed to accomplish this can be selected from a number of known techniques, including but not limited to spraying, rod coating, blade coating, gravure coating (direct, reverse, and offset), flexographic coating, size press (puddle and metered), extrusion hopper coating, and curtain-coating. After drying, the resulting topmost layer can be calendered to improve gloss, but in preferred embodiments extensive calendering is not performed after coating the topmost layer so as to better maintain the rub resistance advantage enabled by the invention.

In one embodiment, in which paper is used as the support, the topmost layer can be applied in line as part of the paper manufacturing process. In another embodiment, the topmost layer may be coated as a separate coating step subsequent to the paper (or other substrate) manufacture. In a particular embodiment, the topmost layer may be applied inline as part of the inkjet printing operation, wherein such layer is applied to a substrate in a pre-coating station prior to printing of inkjet inks. Such inline application may be performed by the various coating processes identified above, or alternatively by a printhead positioned inline with the ink-applying printheads. When a printhead is used to apply the coating solution, the option exists of covering only the printed image area with the coating material, rather than the entire area of the substrate. Pre-coat application provides the advantage of eliminating color-to-color bleed during imaging, since the colorants of the ink are fixed instantaneously as the ink contacts the pre-coated substrate. Furthermore, with pre-coating, images appear darker and have sharper edge definition, since the coating minimizes ink penetration and allows more fixed colorant on the surface. Finally, while the pre-coat material may optionally be dried completely before image printing, complete drying of the pre-coated substrate may not be necessary. Therefore, drying can alternatively be applied once after imaging, resulting in considerable savings in energy.

The topmost layer of the inkjet receiving medium of the invention includes an aqueous-soluble salt of a multivalent metal. Aqueous-soluble is herein defined as at least 0.5 g of the salt capable of dissolving in 100 ml water at 20° C. The salt is preferably essentially colorless and non-reactive. More preferably, the multivalent metal is a cation selected from $Mg^{+2}$, $Ca^{+2}$, $Ba^{+2}$, $Zn^{+2}$, and $Al^{+3}$, most preferably $Ca^{+2}$ or $Mg^{+2}$ in combination with suitable counter ions.

Examples of the salt used in the invention include (but are not limited to) calcium chloride, calcium acetate, calcium nitrate, magnesium chloride, magnesium acetate, magnesium nitrate, barium chloride, barium nitrate, zinc chloride, zinc nitrate, aluminum chloride, aluminum hydroxychloride, and aluminum nitrate. Similar salts will be appreciated by the skilled artisan. Particularly preferred salts are $CaCl_2$, $Ca(CH_3CO_2)_2$, $MgCl_2$, $Mg(CH_3CO_2)_2$, $Ca(NO_3)_2$, or $Mg(NO_3)_2$, including hydrated versions of these salts. Combinations of the salts described above may also be used. The topmost layer preferably comprises calcium ion equivalent to at least 0.05 g/m$^2$ of calcium chloride, more preferably equivalent to at least 0.1 g/m$^2$ of calcium chloride.

The topmost layer further comprises particles comprised primarily of polymer having a Rockwell Hardness of less than R90. Such particles may comprise, e.g., various wax particles, and other sufficiently soft polymer particles. Specific examples include polymer particles comprising, e.g., polyethylene, poly(tetrafluoroethylene), polypropylene, ethylene bis-stearamide, synthetic hydrocarbon waxes, carnauba wax, or a combination thereof. Preferably, the particles are poly (tetrafluoroethylene) particles or wax particles having the specified Rockwell Hardness. Rockwell Hardness values for many polymeric materials are readily available (see, e.g., literature published on-line by Plastics International (http://www.plasticsintl.com/sortable_materials.php)), and such values can further be measured according to ASTM D785-51.

The preferred mode average equivalent spherical diameter (ESD) particle size of the polymer particles is 2.0-10.0 micrometers, more preferably 3-6 micrometers. The applied laydown of these large polymer particles is preferably deliberately kept low enough so as the gloss of the paper is not reduced due to excessive light scatter; the exact laydown is a function of the polymer particle size, but generally will be 0.1 g/m$^2$ or less, preferably 0.05 g/m$^2$ or less. It has been found that the same coatweight of smaller polymer particles is less effective than the larger particles in conferring dry rub protection, despite the much greater numbers per unit area of the smaller polymer particles. By selecting particle having a mode average particle size of greater than 2 micrometers, and more preferably of from 2 to 10 micrometers, coating coverages may be employed enabling both effective dry rub resistance as well as minimizing gloss reduction.

The size of the polymer particles is larger (at least 0.1 micrometer larger and more preferably at least 0.5 micrometer larger) than the minimum coated thickness of the topmost layer, which minimum thickness will be primarily due to the presence of any optional binder in the applied treatment coating. Optional binders include film forming water soluble and water dispersible latex polymers. In a preferred embodiment, the binder polymer may comprise one or more cationic polymer, either alone or in combination with other non-cationic polymer binders. Examples of pre-coat compositions including polymer binders useful for the compositions of the present invention have been described in US patent application 2011/0279554, and in copending, commonly assigned U.S. Ser. No. 13/433,412, the disclosures of which are incorporated by reference herein. Coating laydowns of these treatments are typically 1.0 g/m$^2$ (dry) or lower, preferably 0.5 g/m$^2$ or lower, and electron microscopy cross-sections of such treatments have revealed a very thin polymer film at the surface, which has been measured to be only about 0.5 micrometers thick. Similar SEM cross-sections have shown the thickness of a dried layer of ink, jetted at its maximum laydown, is about 0.1 micrometer thick. Therefore, to provide good dry rub resistance, the polymer particles employed in the present invention are selected so as to have a particle size greater than the combined thicknesses of the applied thickness of the binder layer plus the maximum thickness of the jetted ink layer(s) (i.e., at least 0.1 micrometer greater for a single ink laydown, and more preferably at least 0.5 micrometers greater to exceed the thickness of 4 inks at 100% laydown).

Preferred optional binders for use in the topmost layer in accordance with one embodiment of the present invention include cross-linked hydrophilic polymer binders as disclosed in Dannhauser et al (US 2011/0279554), alone or in combination with one or more additional binders. Such hydrophilic polymer binder comprises a polymer capable of adsorbing water, and preferably is capable of forming a continuous phase solution. Non-exclusive examples of such materials include gelatin, starch, hydroxycelluloses, polyvinyl alcohol, polyvinyl pyrrolidone, polyethylene imine, polyvinyl amine, and derivatives of these materials. A preferred binder is Gohsefimer Z-320 from Nippon Gohsei, an acetylacetate-modified polyvinyl alcohol. The water-adsorbing hydrophilic polymer in the topmost layer coating formulation of such embodiment is crosslinked to improve the print resistance to abrasion while wet, as well as provide increased cohesiveness of the coating upon drying. To provide desired abrasion resistance and cohesiveness, the topmost layer preferably comprises at least 0.02 g/m$^2$ of cross-linked hydrophilic polymer binder. The identity and amount of crosslinker will depend on the choice of polymer and its reactivity with the crosslinker, the number of crosslinking sites available, compatibility with other solution components, and manufacturing constraints such as solution pot life and coating drying speed. Non-exclusive examples of crosslinker materials are glyoxal, Cartabond TSI (Clariant), Cartabond EPI (Clariant), Sequarez 755 (Omnova), glutaraldehyde sodium bisulfate complex (Aldrich), Sunrez 700M (Omnova), Sunrez 700C (Omnova), CR-5L (Esprix), bis(vinyl) sulfone, bis(vinyl) sulfone methyl ether, adipoyl dihydrazide, epichlorohydrin polyamide resins and urea-formaldehyde resins. In a particular embodiment, the cross-linked hydrophilic polymer comprises a cross-linked aceto-acetylated polyvinyl alcohol polymer, such as aceto-acetylated polyvinyl alcohol polymer cross-linked with a glyoxal compound.

Preferred optional binders for use in the topmost layer of the receiving medium in accordance with another embodiment of the invention further includes a cationic polyelectrolyte comprising amidine moieties as described in Xiang and Botros copending, commonly assigned U.S. Ser. No. 13/433,412. Such cationic polyelectrolyte polymers may also conventionally be referred to as polyamidine or polyvinylamidine polymers, and are cationic macromolecules having the structural unit shown by the general formula [1]:

Formula [1]

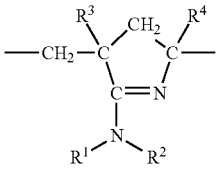

wherein $R^1$ to $R^4$ represent hydrogen atom of an alkyl group such as methyl group. The cationic macromolecule having the structural unit represented by general formula [1] can be prepared by copolymerization of acrylonitrile or methacrylonitrile with N-vinyl-carboxylic acid amine, N-isopropenylcarboxylic acid amide, N-vinylcarboxylic acid amide or N-isopropenylcarboxylic acid amide, followed by hydrolysis of the obtained copolymer to obtain an amidine. There is the possibility that the polyvinylamidine prepared as described above has additional units comprising, e.g., a cyano group derived from acrylonitrile or the like, carbamoyl group formed by hydrolysis of cyano group, and amino group formed by hydrolysis of N-vinylcarboxylic acid amide unit or the like in addition to the structural unit represented by general formula [1]. DIAFLOC KP7000 manufactured by DIANITRIX Company is an example of polyvinylamidine cationic polymer available as a commercial product, which is reported to have the following structure:

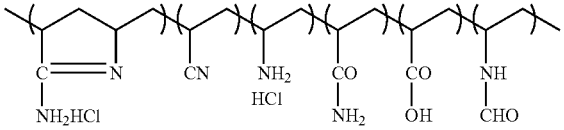

Polyvinyl Amidine

The topmost layer in such embodiment comprising a cationic polyelectrolyte comprising amidine moieties further may include one or more second polymer which is distinct from the cationic polyelectrolyte comprising amidine moieties and which is selected from the group consisting of a polyamide-epichlorohydrin, a polyamine solution polymer, and a waterborne or water-dispersible polyurethane.

Polyamide-epichlorohydrin polymers are water soluble cationic polymers. A representative example of a polyamide-epichlorohydrin polymer which may be used in the present invention is POLYCUP 172, available from Hercules, Inc., which is of the formula:

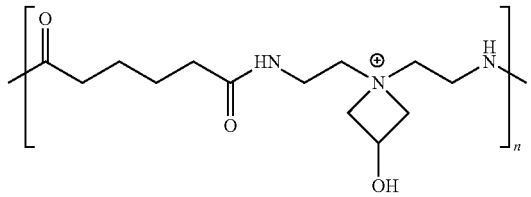

POLYCUP 172 (polyamide-epichlorohydrin)

Polyamine solution polymers are water soluble cationic polymers. A representative example of a polyamine solution polymer which may be used in the present invention is CATIOFAST 159(A), available from the BASF company, which is of the formula:

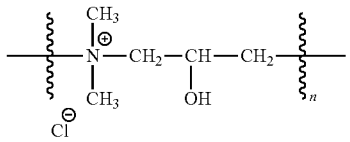

CATIOFAST 159 (A) (polyamine solution polymer)

Waterborne polyurethanes are dispersions of fine polyurethane particles in aqueous medium. Such polymer particles may be of self-dispersable sizes and compositions, or otherwise be treated with additional dispersing agents to be made dispersible. A representative example of a waterborne polyurethane polymer which may be used in the present invention is PRINTRITE DP-376, available from Lubrizol, which is described by the manufacturer as an all aliphatic waterborne polymer dispersion useful in textile, nonwoven, and paper applications, and as a primer on various substrates used for aqueous inkjet printing receivers to improve hydrophilic character.

The topmost layer of the receiving medium of the invention may include additional polymer binders in addition to those specified above. In a further particular embodiment, e.g., a silanol-modified polyvinyl alcohol polymer may additionally be employed. A representative example of a silanol-modified polyvinyl alcohol polymer which may be used in such further embodiment is POVAL R-1130, available from Kuraray Co., which is of the formula:

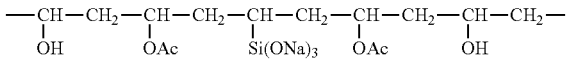

Silanol-modified polyvinyl alcohol

POVAL R-1130

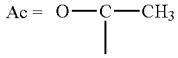

The above polymer binders may be used alone in combinations. Various further polymer binders, including cationic polymers, and combinations thereof useful in the present invention are exemplified in the examples below. To provide desired abrasion resistance and cohesiveness, the topmost layer preferably comprises at least 0.02 g/m$^2$, and more preferably at least 0.05 g/m$^2$, of combined weight of polymer binders.

In accordance with further preferred embodiments of the invention, the topmost layer is coated on the substrate at dry solids coat weight of from 0.1 to 5 g/m$^2$, preferably from 0.1 to 3 g/m$^2$, more preferably from 0.2 to 2 g/m$^2$, even more preferably from 0.2 to 1.5 g/m$^2$, and most preferably from 0.2 to less than 1.0 g/m$^2$, and such layer preferably comprises from 30-98 wt %, more preferably 50-90 wt %, of one or more aqueous soluble salts of multivalent metal cations, from about 1-69 wt % (more preferably 10-50 wt %) of polymer binder, and from about 1 to 10 wt % particles comprised primarily of polymer having a Rockwell Hardness of less than R90 and having a mode equivalent spherical diameter of at least about 2 micrometers, preferably from about 2 to 10 micrometers. The particles comprised primarily of polymer having a Rockwell Hardness of less than R90 are further preferably coated in an amount of from 0.01 up to and including 0.05 grams/m$^2$. Such combination of relatively low total solid laydown and relatively high multivalent metal salt concentration in a topmost coating composition, along with use of the specified combination of polymer particles and optional polymer binders, surprisingly has been found to enable improved inkjet printing performance when printing pigment-based aqueous inks on a variety of substrates, including coated offset papers as discussed above.

The topmost layer coating formulation may further comprise additional optional components, such as additional inorganic or organic particles, though it is preferred that the coating solid laydown and relative concentration preferences of the invention still be met. These can include, but are not limited to, kaolin clay, montmorillonite clay, delaminated kaolin clay, calcium carbonate, calcined clay, silica gel, fumed silica, colloidal silica, talc, wollastinite, fumed alumina, colloidal alumina, titanium dioxide, zeolites, or organic polymeric particles such as Dow HS3000NA.

Another aspect of the invention is directed to a method of printing in which the above-described receiver is printed with an inkjet printer employing at least one pigment-based colorant in an aqueous ink composition. Preferably, the pigment-based colorants are stabilized using anionic dispersants. Such dispersants can be polymeric, containing repeating sub-units, or may be monomeric in nature. The present invention is particularly advantageous for printing periodicals, newspapers, magazines, and the like. The printing method may employ a continuous high-speed commercial inkjet printer, for example, in which the printer applies colored images from at least two different print heads, preferably full-width printheads with respect to the media, in sequence in which the different colored parts of the images are registered.

One type of printing technology, commonly referred to as "continuous stream" or "continuous" inkjet printing, uses a pressurized ink source that produces a continuous stream of ink droplets. Conventional continuous inkjet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink-capturing mechanism (catcher, interceptor, gutter, etc.) and either recycled or disposed of. When print is desired, the ink droplets are not deflected and allowed to strike a print medium. Alternatively, deflected ink droplets may be allowed to strike the print media, while non-deflected ink droplets are collected in the ink capturing mechanism.

Typically, continuous inkjet printing devices are faster than droplet on demand devices and produce higher quality printed images and graphics. However, each color printed requires an individual droplet formation, deflection, and capturing system. Such continuous inkjet printing devices employ a high-speed inkjet receiving medium transport system capable of transporting at least one of roll-fed or sheet fed receiving medium, in combination with a continuous inkjet printhead for image-wise printing of inkjet ink onto the receiving medium and a drying station for drying of the printed image. Use of a topmost layer in accordance with the present invention in such a high speed continuous inkjet printing device advantageously enables an aqueous pigment-based printed inkjet image to be initially stabilized upon the surface of the receiving medium until the printed image can be dried in the device drying station to result in improved image quality, especially when printing on substrates comprising relatively hydrophobic coated offset papers or aqueous ink impermeable plastic films.

Examples of conventional continuous inkjet printers include U.S. Pat. No. 1,941,001 issued to Hansell on Dec. 26, 1933; U.S. Pat. No. 3,373,437 issued to Sweet et al. on Mar. 12, 1968; U.S. Pat. No. 3,416,153 issued to Hertz et al. on Oct. 6, 1963; U.S. Pat. No. 3,878,519 issued to Eaton on Apr. 15, 1975; and U.S. Pat. No. 4,346,387 issued to Hertz on Aug. 24, 1982.

A more recent development in continuous stream inkjet printing technology is disclosed in U.S. Pat. No. 6,554,410 to Jeanmaire, et al. The apparatus includes an ink-drop-forming mechanism operable to selectively create a stream of ink droplets having a plurality of volumes. Additionally, a droplet deflector having a gas source is positioned at an angle with respect to the stream of ink droplets and is operable to interact with the stream of droplets in order to separate droplets having one volume from ink droplets having other volumes. One stream of ink droplets is directed to strike a print medium and the other is directed to an ink catcher mechanism.

The colorant systems of the ink jet ink compositions employed in accordance with one embodiment of the invention may be dye-based, pigment-based or combinations of dye and pigment. Compositions incorporating pigment are particularly useful. Pigment-based ink compositions are used because such inks render printed images having higher optical densities and better resistance to light and ozone as compared to printed images made from other types of colorants. A wide variety of organic and inorganic pigments, alone or in combination with additional pigments or dyes, can be in the present invention. Pigments that may be used in the invention include those disclosed in, for example, U.S. Pat. Nos. 5,026,427; 5,086,698; 5,141,556; 5,160,370; and 5,169,436. The exact choice of pigments will depend upon the specific application and performance requirements such as color reproduction and image stability.

Pigments suitable for use in the invention include, but are not limited to, azo pigments, monoazo pigments, di-azo pigments, azo pigment lakes, β-Naphthol pigments, Naphthol AS pigments, benzimidazolone pigments, di-azo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black. In accordance with one embodiment of the invention, colorants comprising cyan, magenta, or yellow pigments are specifically employed. The pigment particles useful in the invention may have any particle sizes which can be jetted through a print head. Preferably, the pigment particles have a mean particle size of less than about 0.5 micrometer, more preferably less than about 0.2 micrometer.

Self-dispersing pigments that are dispersible without the use of a dispersant or surfactant can be used in the invention. Pigments of this type are those that have been subjected to a surface treatment such as oxidation/reduction, acid/base treatment, or functionalization through coupling chemistry. The surface treatment can render the surface of the pigment with anionic, cationic or non-ionic groups such that a separate dispersant is not necessary. The preparation and use of covalently functionalized self-dispersed pigments suitable for inkjet printing are reported by Bergemann, et al., in U.S. Pat. No. 6,758,891 B2 and U.S. Pat. No. 6,660,075 B2, Belmont in U.S. Pat. No. 5,554,739, Adams and Belmont in U.S. Pat. No. 5,707,432, Johnson and Belmont in U.S. Pat. No. 5,803,959 and 5,922,118, Johnson et al in and U.S. Pat. No. 5,837,045, Yu et al in U.S. Pat. No. 6,494,943 B1, and in published applications WO 96/18695, WO 96/18696, WO 96/18689, WO 99/51690, WO 00/05313, and WO 01/51566, Osumi et al., in U.S. Pat. No. 6,280,513 B1 and U.S. Pat. No. 6,506,239 B1, Karl, et al., in U.S. Pat. No. 6,503,311 B1, Yeh, et al., in U.S. Pat. No. 6,852,156 B2, Ito et al., in U.S. Pat. No. 6,488,753 B1 and Momose et al., in EP 1,479,732 A1.

Pigment-based ink compositions employing non-self-dispersed pigments that are useful in the invention may be prepared by any method known in the art of inkjet printing. Dispersants suitable for use in the invention in preparing stable pigment dispersions include, but are not limited to, those commonly used in the art of inkjet printing. For aqueous pigment-based ink compositions, particularly useful dispersants include anionic surfactants such as sodium dodecylsulfate, or potassium or sodium oleylmethyltaurate as described in, for example, U.S. Pat. No. 5,679,138, U.S. Pat. No. 5,651,813 or U.S. Pat. No. 5,985,017.

Polymeric dispersants are also known and useful in aqueous pigment-based ink compositions. Polymeric dispersants include polymers such as homopolymers and copolymers; anionic, cationic or nonionic polymers; or random, block, branched or graft polymers. The copolymers are designed to act as dispersants for the pigment by virtue of the arrangement and proportions of hydrophobic and hydrophilic monomers. The pigment particles are colloidally stabilized by the dispersant and are referred to as a polymer dispersed pigment dispersion. Polymer stabilized pigment dispersions have the additional advantage of offering image durability once the inks are dried down on the ink receiver substrate.

Preferred copolymer dispersants are those where the hydrophilic monomer is selected from carboxylated monomers. Preferred polymeric dispersants are copolymers prepared from at least one hydrophilic monomer that is an acrylic acid or methacrylic acid monomer, or combinations thereof. Preferably, the hydrophilic monomer is methacrylic acid. Particularly useful polymeric pigment dispersants are further described in US 2006/0012654 A1 and US 2007/0043144 A1, the disclosures of which are incorporated herein by reference.

Inkjet inks printed onto inkjet receiving media in accordance with the invention may contain further addendum as is conventional in the inkjet printing art. Polymeric dispersed pigment-based aqueous inkjet ink formulations suitable for use in particular embodiments of the present invention include those described, e.g., in U.S. Patent Publication Nos. US2011/0123714, US2011/0122180, US2010/0302292, and US2010/0304028, the disclosures of which are incorporated by reference herein in their entireties.

The inkjet ink compositions printed onto inkjet receiving media in accordance with the invention further may comprise polymer additive which is distinct from any dispersant which may be used to disperse the pigment particles. The polymer additives can act as ingredient binders which may form films and further increase printed image dry physical or wet durability. These polymers may be classified as water-soluble polymers, water-reducible polymers or water-dispersible polymeric particles, and include nonionic, anionic, and amphoteric polymers. Representative examples of water soluble polymers include, polyvinyl alcohols, polyvinyl acetates, polyvinyl pyrrolidones, carboxymethyl cellulose, polyethyloxazolines, and polyamides. Representative examples of water-reducible polymers include alkali soluble resins, polyurethanes (such as those found in U.S. Pat. No. 6,268,101), polyacrylic acids, styrene-acrylic methacrylic acid copolymers (such as Joncryl® 70 from BASF Corp., TruDot® IJ-4655 from MeadWestvaco Corp., and Vancryl® 68S from Air Products and Chemicals, Inc) and polymers exemplified in U.S. Pat. No. 6,866,379 and U.S. Patent Application No 2005/0134665 A1. Examples of water dispersible polymeric particles used in inkjet inks are styrene-acrylic copolymers sold under the trade names Joncryl® (BASF Corp.), Ucar™ (Dow Chemical Co.), Jonrez®(MeadWestvaco Corp.), and Vancryl® (Air Products and Chemicals, Inc.); sulfonated polyesters sold under the trade name Eastman AQ® (Eastman Chemical Co.); polyethylene or polypropylene resin emulsions and polyurethanes (such as the Witcobonds® from Witco Corp.). These polymeric particles are preferred because they are compatible in typical aqueous-based ink compositions, and because they render printed images that are highly durable towards physical abrasion, light and ozone.

Particularly preferred polymers for use in the black, cyan, magenta and yellow inks of the ink sets employed in embodiments of the invention are water soluble polyacrylate copolymers and polyurethane latex binder co-polymers, which may be used alone or in mixtures. The water soluble polyacrylate polymers can be either addition polymers or condensation polymers, both of which are well known to those skilled in the art of polymer chemistry. Polyurethane latex binders may be formed from at least one monomer comprising at least two hydroxyl groups and at least one carboxyl group and another monomer comprising at least two isocyanate groups. Water-dispersible polyurethanes are disclosed as binders in pigmented inks in U.S. Pat. No. 6,533,408, and particularly useful polyurethanes for pigmented inkjet inks which exhibit good jetting performance and good resulting image durability are described in U.S. Patent Application No. 2004/0085419A1, the disclosures of both are incorporated herein by reference. While any useful quantity of a polyurethane latex binder can be employed, the cyan, magenta, yellow, and black inks of the ink set employed in embodiments of the invention in a preferred embodiment each preferably comprise between 0.1 and 5% by weight, and more preferably present at between 0.5 and 3% by weight of a polyurethane latex binder.

EXAMPLES

Example 1

Treatment solutions TS-1.1 and TS-1.2 are comprised of the same components, but in different proportions. These are described in the Table 1.1 below:

TABLE 1.1

| component | parts dry active ingredient TS-1.1 | TS-1.2 |
|---|---|---|
| CaCl2 | 50.0 | 42.0 |
| Z320 PVA-acac | 13.8 | 28.0 |
| Raycat56 latex | 9.2 | 12.0 |
| Polycup172 crosslinker | 3.5 | 6.0 |
| matte/wax | 4.0 | 5.0 |

The coating experiment outlined below examined changes in surfactant package, crosslinker level, and replacement of cross-linked methylmethacrylate polymer matte bead particles (Kodak MP1, 4 micrometer average particle size) with Lanco 1796 (Lubrizol, PTFE wax powder, 6 micrometer average particle size) on dry rub resistance. Cross-linked methylmethacrylate polymer has an estimated Rockwell hardness of R100, and PTFE has an estimated Rockwell hardness of R58, based on literature published on-line by Plastics International (http://www.plasticsintl.com/sortable_materials.php). The solutions were coated on Sterling Ultragloss (NewPage) offset paper using a lab-scale extrusion hopper coating machine. Dry rub resistance was measured by printing the coated sample using a KODAK PROSPER continuous inkjet pilot printer with a KODAK PROSPER polymeric dispersant dispersed pigmented inkset wherein the inks included polyurethane polymer latex for added print durability. The printed samples were dried for 3 days at ambient conditions. Then, a 100% black density patch was rubbed with a 2"×4" piece of bond paper beneath a 4 lb. weight for 10 back and forth cycles using a Sutherland rub tester. Dry rub resistance was characterized by measuring the % density loss in the abraded black patch (less is better). The Table 1.2 below summarizes the results.

TABLE 1.2

| sample | g/m$^2$ (dry) | solution | matte type | cross-linker | surfactant | dry rub % density loss |
|---|---|---|---|---|---|---|
| 1.1 | 0.9 | TS-1.1 | MP1 | 1x | A | 23% |
| 1.2 | 1.0 | TS-1.2 | MP1 | 1x | A | 14% |
| 1.3 | 1.0 | TS-1.2 | MP1 | 1x | B | 22% |
| 1.4 | 0.9 | TS-1.1 | MP1 | 1x | A | 25% |
| 1.5 | 0.9 | TS-1.1 | Lanco1796 | 1x | A | −2% |
| 1.6 | 0.9 | TS-1.1 | Lanco1796 | 1x | C | −1% |
| 1.7 | 0.9 | TS-1.1 | Lanco1796 | 1x | D | −1% |
| 1.8 | 0.9 | TS-1.1 | MP1 | 1x | D | 18% |
| 1.9 | 0.9 | TS-1.1 | Lanco1796 | 1x | E | −1% |
| 1.10 | 0.9 | TS-1.1 | Lanco1796 | 0.67x | D | −2% |
| 1.11 | 0.9 | TS-1.1 | Lanco1796 | 1.33x | D | 1% |
| 1.12 | 1.0 | TS-1.2 | MP1 | 1x | A | 9% |
| 1.13 | 1.0 | TS-1.2 | Lanco1796 | 1x | A | 1% |
| 1.14 | 1.0 | TS-1.2 | Lanco1796 | 1x | C | −2% |
| 1.15 | 1.0 | TS-1.2 | Lanco1796 | 1x | D | 1% |
| 1.16 | 1.0 | TS-1.2 | MP1 | 1x | D | 3% |
| 1.17 | 1.0 | TS-1.2 | Lanco1796 | 1x | E | −1% |
| 1.18 | 1.0 | TS-1.2 | Lanco1796 | 0.67x | D | −2% |
| 1.19 | 1.0 | TS-1.2 | Lanco1796 | 1.33x | D | 1% |

Surfactants (all expressed as % active by weight total coating solution):

A = 0.1% Agitan299 antifoamant (Munzing)

B = 0.3% Agitan299 antifoamant (Munzing)

C = 0.5% DaPro7580 antifoamant (Elementis Specialties) + 0.1% Surfynol440 surfactant/wetting agent (Air Products)

D = 0.35% DaPro7580 antifoamant (Elementis Specialties) + 0.1% Surfynol440 surfactant/wetting agent (Air Products)

E = 0.2% DaPro7580 antifoamant (Elementis Specialties) + 0.1% Surfynol440 surfactant/wetting agent (Air Products)

Note that all coatings containing Lanco 1796 with particle size and Rockwell hardness in accordance with the present invention show significantly improved dry rub resistance, regardless of solution component ratios, cross-linker level, or surfactant package. Also note that the size of the matte/wax particle is not the sole determinant of dry rub resistance, as the similar sized cross-linked PMMA beads having a higher Rockwell hardness did not perform as well.

Example 2

Treatment solution TS-2 is comprised of 9.9 parts CaCl2 salt (Oxychem), 1.0 parts Catiofast159A polyamime polymer (BASF), 0.25 parts PrintRite DP376 polyurethane latex (Lubrizol), and 0.2 parts guar gum thickener (TIC Gums). This was coated at 0.65 g/m$^2$ dry laydown on Sterling Ultragloss offset paper using a lab-scale extrusion hopper coater. The coated paper was printed and tested for dry rub as described in Example 1, and shows very poor dry rub resistance. Additional coatings were made with similar solutions that contained Lanco 1796 PTFE wax (Lubrizol, 6 micrometer average particle size) or Lanco 1799 PTFE wax (Lubrizol, 4 micrometer average particle size). The Lanco waxes were added at levels so as provide 0.01, 0.02, and 0.04 g/m$^2$ to the dry coatings. When these coatings were printed and tested for dry rub resistance, dramatic improvements in dry rub resistance were observed for these formulations relative to the base TS-2 solution. This is summarized in the Table 2.1 below:

TABLE 2.1

| Sample | details | dry rub % density loss |
|---|---|---|
| 2.1 | TS-2 | 61.1% |
| 2.2 | TS-2 plus 0.01 g/m$^2$ Lanco1796 | 0.9% |
| 2.3 | TS-2 plus 0.02 g/m$^2$ Lanco1796 | 0.0% |
| 2.4 | TS-2 plus 0.04 g/m$^2$ Lanco1796 | −0.4% |
| 2.5 | TS-2 plus 0.01 g/m$^2$ Lanco1799 | −0.2% |
| 2.6 | TS-2 plus 0.02 g/m$^2$ Lanco1799 | −1.3% |
| 2.7 | TS-2 plus 0.04 g/m$^2$ Lanco1799 | 0.9% |

Example 3

Treatment solution TS-3 is comprised of 50 parts CaCl2 (anhydrous, Oxychem), 22 parts Z320 modified polyvinyl alcohol (Nippon Gohsei), 9 parts Raycat56 cationic styrene-acrylic latex (Specialty Polymer, Inc.), 4.7 parts Polycup172 crosslinker (Ashland). A series of matte particles and waxes of varying composition, size, and laydown were added to TS-3 as described in the table below and coated to assess their impact on dry rub resistance. Matte particles MP1, MP2, and MP3 were made at Kodak; Lanco 1796 and Lanco 1799 were obtained from Lubrizol Advanced Materials, Inc.; CoatOSil DSA 6 was obtained from Momentive Performance Chemicals, Inc.; Hydrocerf 9174, Fluoropure Ultrafine 50CW, and nanoFlon W50C were obtained from Shamrock Technologies, Inc.; Acumist A6 was obtained from Honeywell. The sizes of the particles were measured in water/surfactant dispersions using a Horiba LA-920 particle size analyzer; the mode ESD particle size is reported. Rockwell hardness values were estimated based on literature published on-line by Plastics International (http://www.plasticsintl.com/sortable_materials.php); the hardness for CoatOSil DSA6 was estimated to be ~R100 from the description of the manufacturing procedure (U.S. Pat. No. 5,789,0517). All these solutions were coated on Sterling Ultragloss (NewPage) offset paper using a lab-scale extrusion hopper coating machine with 0.1% Olin 10G (dry weight relative to solution weight) added to each coating solution as a spreading agent. After drying, the coatings were printed on a KODAK PROSPER continuous inkjet print stand using standard KODAK PROSPER polymeric dispersant dispersed pigmented inks. A test patch of black ink printed over yellow ink was subjected to dry rub testing as described in Example 1. The amount of retained black ink was used to quantify dry rub resistance. This was calculated by measuring the visual densities of the black over yellow color patch before and after the dry rub test, the visual density of an unrubbed yellow color patch, and calculating the % visual density lost using the following equation:

$$\%\ D\text{vis lost}=100\times\{D\text{vis}(K/Y\text{ before rub})-D\text{vis}(K/Y\text{ after rub})\}/\{D\text{vis}(K/Y\text{ before rub})-D\text{vis}(Y\text{only})\}$$

Results are summarized in the Table 3.1 below.

TABLE 3.1

| part | details | matte/wax composition | particle laydown ($g/m^2$ dry) | est. Rockwell R hardness | mode-measured size (um) | Dmin Gloss @ 75 F. | Black over Yellow dry rub (% Dvis lost) | Dynam. CoF (sled/sheet) |
|---|---|---|---|---|---|---|---|---|
| 3.1 | p1: 0.65 g/m2 solids from solution TS-3 | none | 0 | | 0.0 | 68.5 | 76.4% | 0.424 |
| 3.2 | p1 + 0.005 gsm MP1 (Kodak) | Si-covered cross-linked PMMA | 0.005 | 100 | 3.6 | 67.0 | 81.3% | 0.407 |
| 3.3 | p1 + 0.021 gsm MP1 (Kodak) | Si-covered cross-linked PMMA | 0.021 | 100 | 3.6 | 64.0 | 74.6% | 0.412 |
| 3.4 | p1 + 0.065 gsm MP1 (Kodak) | Si-covered cross-linked PMMA | 0.065 | 100 | 3.6 | 52.6 | 72.2% | 0.434 |
| 3.5 | p1 + 0.005 gsm MP2 (Kodak) | cross-linked PMMA | 0.005 | 100 | 3.2 | 66.8 | 74.0% | 0.458 |
| 3.6 | p1 + 0.021 gsm MP2 (Kodak) | cross-linked PMMA | 0.021 | 100 | 3.2 | 62.5 | 73.2% | 0.442 |
| 3.7 | p1 + 0.065 gsm MP2 (Kodak) | cross-linked PMMA | 0.065 | 100 | 3.2 | 55.3 | 70.2% | 0.431 |
| 3.8 | p1 + 0.005 gsm Lanco ™1799 | PTFE | 0.005 | 58 | 3.2 | 67.4 | 12.8% | 0.427 |
| 3.9 | p1 + 0.021 gsm Lanco ™1799 | PTFE | 0.021 | 58 | 3.2 | 63.5 | −2.6% | 0.403 |
| 3.10 | p1 + 0.065 gsm Lanco ™1799 | PTFE | 0.065 | 58 | 3.2 | 57.1 | −2.0% | 0.361 |
| 3.11 | p1 + 0.021 gsm Lanco ™1796 | PTFE | 0.021 | 58 | 7.2 | 65.1 | −1.6% | 0.367 |
| 3.12 | p1 + 0.054 gsm Lanco ™1796 | PTFE | 0.054 | 58 | 7.2 | 60.8 | −1.2% | 0.330 |
| 3.13 | p1 + 0.108 gsm Lanco ™1796 | PTFE | 0.108 | 58 | 7.2 | 54.4 | −2.0% | 0.291 |
| 3.14 | p1 + 0.011 gsm MP3 (Kodak) | polystyrene | 0.011 | 95 | 4.8 | 67.0 | 14.6% | 0.341 |
| 3.15 | p1 + 0.032 gsm MP3 (Kodak) | polystyrene | 0.032 | 95 | 4.8 | 63.4 | 61.6% | 0.361 |
| 3.16 | p1 + 0.065 gsm MP3 (Kodak) | polystyrene | 0.065 | 95 | 4.8 | 58.6 | 63.5% | 0.413 |
| 3.17 | p1 + 0.011 CoatOSil DSA6 | silicone micro resin | 0.011 | 100 | 4.7 | 68.0 | 68.9% | 0.318 |
| 3.18 | p1 + 0.043 gsm CoatOSil DSA6 | silicone micro resin | 0.043 | 100 | 4.7 | 65.2 | 55.8% | 0.307 |
| 3.19 | p1 + 0.108 gsm CoatOSil DSA6 | silicone micro resin | 0.108 | 100 | 4.7 | 56.5 | 46.2% | 0.323 |
| 3.20 | p1 + 0.021 gsm Hydrocerf 9174 | PTFE | 0.021 | 58 | 6.3 | 62.5 | 2.1% | 0.311 |
| 3.21 | p1 + 0.054 gsm Hydrocerf 9174 | PTFE | 0.054 | 58 | 6.3 | 56.1 | −1.0% | 0.290 |
| 3.22 | p1 + 0.108 gsm Hydrocerf 9174 | PTFE | 0.108 | 58 | 6.3 | 45.9 | −2.3% | 0.292 |
| 3.23 | p1 + 0.002 gsm Fluoropure Ultrafine 50CW | PTFE | 0.002 | 58 | 0.3 | 67.8 | 60.7% | 0.332 |
| 3.24 | p1 + 0.005 gsm Fluoropure Ultrafine 50CW | PTFE | 0.005 | 58 | 0.3 | 68.9 | 46.7% | 0.328 |
| 3.25 | p1 + 0.032 gsm Fluoropure Ultrafine 50CW | PTFE | 0.032 | 58 | 0.3 | 61.1 | 12.8% | 0.316 |
| 3.26 | p1 + 0.001 gsm nanoFLON W50C | PTFE | 0.001 | 58 | 0.4 | 68.3 | 65.7% | 0.348 |
| 3.27 | p1 + 0.005 gsm nanoFLON W50C | PTFE | 0.005 | 58 | 0.4 | 67.5 | 57.6% | 0.331 |

TABLE 3.1-continued

| part | details | matte/wax composition | particle laydown (g/m² dry) | est. Rockwell R hardness | mode-measured size (um) | Dmin Gloss @ 75 F. | Black over Yellow dry rub (% Dvis lost) | Dynam. CoF (sled/sheet) |
|---|---|---|---|---|---|---|---|---|
| 3.28 | p1 + 0.027 gsm nanoFLON W50C | PTFE | 0.027 | 58 | 0.4 | 63.9 | 23.2% | 0.298 |
| 3.29 | p1 + 0.011 gsm Acumist A6 | oxidized PE | 0.011 | 55 | 8.2 | 66.3 | 0.4% | 0.326 |
| 3.30 | p1 + 0.032 gsm Acumist A6 | oxidized PE | 0.032 | 55 | 8.2 | 65.0 | −0.4% | 0.283 |
| 3.31 | p1 + 0.108 gsm Acumist A6 | oxidized PE | 0.108 | 55 | 8.2 | 61.6 | −0.2% | 0.267 |

Note the greatly improved dry rub resistance from the larger PTFE particles and the Acumist A6 (oxidized PE) particles. However, not all large particles provide good dry rub resistance; the methylmethacrylate, silicone microresin, and polystyrene particles are examples of this. Note that these less effective particles have Rockwell hardness values greater than R90. Also of note is that smaller PTFE particles are less effective at conferring dry rub resistance relative to equal laydowns of larger PTFE particles. This is unexpected; at constant coatweight, the number of larger particles should decrease as a function of the (particle size)$^3$. However, it is desired that the dry laydowns of these particles be kept low enough (~0.01-0.05 g/m$^2$) so as to minimally reduce the gloss of the coating.

The dynamic coefficient of friction of the coatings was measured using a brushed stainless steel sled against the coated paper surface. Comparison of these values to the % Dvis lost metric for dry rub shows coefficient of friction is not a satisfactory property for predicting dry rub resistance. For instance, samples 3.14 through 3.16 have a coefficient of friction comparable to or even lower than samples 3.8 through 3.10, yet the dry rub resistance is noticeably poorer for the former samples. Similarly, samples 3.23 through 3.28 all have coefficient of friction values equal or lower than samples 3.8 through 3.13, yet samples 3.23 through 3.28 have poorer dry rub resistance.

A multiple linear regression analysis of the data in Table 3.1 shows a strong correlation of improved dry rub resistance with increasing particle size and softer particles. Further analysis shows decreasing coating gloss to be strongly correlated with increasing particle laydown. A softer, more deformable particle (lower Rockwell hardness) thus is required for the desired dry rub resistance of the printed image, combined with a larger particle size to provide sufficient spacing between the print and the plain paper abradant with its relatively rough topography. Sufficient numbers of particles must be present to maintain this spacing, yet not so many as to cause significant light scatter from the coating surface which will decrease coating gloss. A preferred embodiment of the invention is the use of 0.01 to 0.05 g/m$^2$ of particles of Rockwell hardness less than R90, more preferably less than R75, with a mode particle ESD size of at least 2 micrometers, more preferably at least 3 micrometers, and most preferably 3 to 10 micrometers. A more preferred embodiment employs 0.02 to 0.04 g/m$^2$ of such particles.

Example 4

Varying types of PTFE waxes were added to a treatment solution TS-4 comprising 8.75% CaCl2, 5.0% Catiofast 159A solution (50% solids polyamine solution polymer, BASF), 0.63% Printrite DP376 (40% solids polyurethane latex, Lubrizol), 0.01% each Agitan731 and Agitan299 (defoamants, Munzing), 0.1% Metolat 725 (surfactant, Munzing), and 0.2% Kordek MLX (biocide, Dow Chemical). These were applied to Sterling Ultra gloss offset paper (NewPage) by hand coating with a #2.5 wound wire rod and dried with a hot air gun. KODAK PROSPER polymeric dispersant dispersed pigmented inks including polyurethane polymer latex for added print durability were applied to the above coatings by handcoating with a #2.5 wound wire rod followed by drying with a hot air gun. Black ink was applied in this way alone and over a previously and similarly coated yellow ink. After drying, the printed areas were tested for dry rub resistance as described in Example 1. The results are summarized in the following Table 4.1.

TABLE 4.1

| | | | | Kinetic CoF | | | |
|---|---|---|---|---|---|---|---|
| | Average | Dry Coat | | On Treated | On Black over Yellow over | Immediate Dry Rub (density loss), % | |
| PTFE Type | Particle Size (micrometer) | Weight* (g/m²) | PTFE* (g/m²) | Paper Surface | Treated Paper Surface | Black | Black/Yellow |
| nanoFLON W50C | 0.4 (measured mode) | 0.66 | 0.03 | 0.161 | 0.535 | 32.20 | 13.59 |
| Fluoro AQ 50 | 1 (per manufacturer) | 0.66 | 0.03 | 0.181 | 0.576 | 23.37 | N/A |
| Hydrocerf 9174 | 6.3 (measured mode) | 0.66 | 0.03 | 0.235 | 0.467 | 1.37 | 4.77 |
| Fluotron 109 | 3 to 5 (per manufacturer) | 0.66 | 0.03 | 0.28 | 0.623 | 5.00 | 45.28 |

*based about 5.0 micron wet coating with #2.5 wired rod

Improved dry rub performance was obtained for the larger wax polymer particles relative to equal coat weights of the smaller wax polymer particles.

Example 5

Another series of hand coatings were made using the same procedures as described in Example 4. These coatings tested different treatment solutions TS-5.1 to TS-5.7, that are described in the Table 5.1 below. Note parts 5.2, 5.4, 5.5, 5.6, and 5.7 have large wax polymer particles (Hydrocerf 9174) added to the formulations. Dry rub was tested as described in earlier examples on Dmax black-only patches and on Dmax black printed over Dmax yellow patches.

TABLE 5.1

| | | | | Kinetic CoF | | | |
|---|---|---|---|---|---|---|---|
| | | Dry Coat | | On Treated | On Black over Yellow over | Immediate Dry Rub (density loss), % | |
| Formula | Key Components | Weight* ($g/m^2$) | PTFE* ($g/m^2$) | Paper Surface | Treated Paper Surface | Black | Black/ Yellow |
| TS-5.1 | 0.20% Ticaxan Xathan EC + 10% CaCl2 | 0.55 | 0 | 0.413 | 0.712 | 76.87 | 85.00 |
| TS-5.2 | 0.20% Ticaxan Xathan EC + 10% CaCl2 + 0.6% Hydrocerf 9174 | 0.58 | 0.03 | 0.242 | 0.466 | 3.29 | 0.47 |
| TS-5.3 | 0.50% R-1130 + 2.00% Catiofast 159 (A) + 0.20% PrintRite DP-376 + 0.20% ME 09730 + 10% CaCl2 + 0.20% Ticaxan Xanthan EC | 0.70 | 0 | 0.370 | 0.748 | 70.18 | 87.00 |
| TS-5.4 | 0.50% R-1130 + 2.00% Catiofast 159 (A) + 0.20% PrintRite DP-376 + 10% CaCl2 + 0.20% ME 09730 + 0.60% Hydrocerf 9174 + 0.20% Ticaxan Xanthan EC | 0.73 | 0.03 | 0.263 | 0.524 | 2.87 | 0.82 |
| TS-5.5 | 0.62% R-1130 + 2.5% Catiofast 159 (A) + 0.25% PrintRite DP-376 + 0.48% Polycup 172 + 8.75% CaCl2 + 0.60% Hydrocerf 9174 + 0.20% Ticaxan Xanthan EC | 0.73 | 0.03 | 0.220 | 0.463 | 0.46 | 2.02 |
| TS-5.6 | 2.5% Catiofast 159 (A) + 0.25% PrintRite DP-376 + 8.75% CaCl2 + 0.60% Hydrocerf 9174 + 0.20% Ticaxan Xanthan EC | 0.66 | 0.03 | 0.196 | 0.488 | 0.26 | 1.86 |
| TS-5.7 | 1.33% KP-7000 + 2.67% Catiofast 159 (A) + 9.33% CaCl2 + 0.60% Hydrocerf 9174 | 0.75 | 0.03 | 0.324 | 0.523 | 2.33 | 2.18 |

| Component | Source | ingredient |
|---|---|---|
| Ticaxan Xanthan EC | TIC gums | Xanthan gum |
| Catiofast 159(A) | BASF | Polyamine solution polymer (cationic) |
| Poval R-1130 | Kuraray | silanol modified polyvinyl alcohol |
| Polycup 172 | Ashland | Polyamide-epichlorohydrin (crosslinker) |
| PrintRite DP376 | Lubrizol | Polyurethane |
| Hydrocerf 9174 | Shamrock | dispersion of 4 micron PTFE |
| Hydrocerf 797 | Shamrock | dispersion of 6 micron high MW PE and PTFE |
| KP7000 | Esprix | polyamidine-based polymer |

The addition of the large polymer particles in accordance with the present invention provides improved dry rub performance to a variety of treatment solutions.

The invention has been described in detail with particular reference to certain preferred embodiments thereof, but it will be understood that variations and modifications can be effected within the spirit and scope of the invention.

The invention claimed is:

1. An inkjet receiving medium comprising a substrate and having a topmost layer coated thereon, wherein the topmost layer comprises one or more aqueous soluble salts of multivalent metal cations and particles comprised primarily of polymer having a Rockwell Hardness of less than R90, where the topmost layer is coated at a dry solids coat weight of from 0.1 to 5 $g/m^2$ and comprises at least 30 wt % of the one or more aqueous soluble salts of multivalent metal cations, and provides at least 0.01 $g/m^2$ of particles comprised primarily of polymer having a Rockwell Hardness of less than R90 and which have an equivalent spherical diameter of i) at least about 2 micrometers and ii) at least 0.1 micrometer greater than the minimum coated thickness of the topmost layer.

2. The inkjet receiving media of claim 1, wherein the topmost layer is coated at a dry solids coat weight of from 0.1 to 3 $g/m^2$.

3. The inkjet receiving media of claim 2, wherein the topmost layer comprises from 30-98 wt % of the one or more aqueous soluble salts of multivalent metal cations, from 1-69 wt % of polymer binder, and from 1 to 10 wt % of the particles comprised primarily of polymer having a Rockwell Hardness of less than R90.

4. The inkjet receiving media of claim 3, wherein the topmost layer comprises a cationic polymer.

5. The inkjet receiving media of claim 4, wherein the one or more multivalent metal salts comprise a calcium salt.

6. The inkjet receiving media of claim 5, wherein the topmost layer comprises calcium ion equivalent to at least 0.10 $g/m^2$ of calcium chloride.

7. The inkjet receiving media of claim 2, wherein the topmost layer is coated at a dry solids coat weight of from 0.2 to 2 $g/m^2$.

8. The inkjet receiving media of claim 2, wherein the topmost layer is coated at a dry solids coat weight of from 0.2 to 1.5 $g/m^2$.

9. The inkjet receiving media of claim 2, wherein the topmost layer is coated at a dry solids coat weight of from 0.2 to less than 1.0 $g/m^2$.

10. The inkjet receiving media of claim 1, wherein the substrate is capable of adsorbing and transferring an aqueous ink colorant to the substrate interior prior to being coated thereon with the topmost layer.

11. The inkjet receiving media of claim 1, wherein the substrate comprises a relatively hydrophobic surface prior to being coated thereon with the topmost layer, and the topmost continuous layer provides a continuous relatively hydrophilic surface in comparison to the relatively hydrophobic substrate surface prior to being coated.

12. The inkjet receiving media of claim 1, wherein the substrate is a coated offset paper.

13. The inkjet receiving medium of claim 1, wherein the particles comprised primarily of polymer having a Rockwell Hardness of less than R90 have a mode equivalent spherical diameter of at least about 2 micrometers.

14. The inkjet receiving medium of claim 1, where the topmost layer comprises 0.01 to 0.05 $g/m^2$ of particles comprised primarily of polymer having a Rockwell Hardness of less than R90 and having a mode equivalent spherical diameter of from 2 to 10 micrometers.

15. The inkjet receiving medium of claim 1, wherein the topmost layer provides 0.01 to 0.05 $g/m^2$ of particles comprised primarily of polymer having a Rockwell Hardness of less than R90.

16. The inkjet receiving medium of claim 1, wherein the topmost layer provides 0.01 to 0.05 $g/m^2$ of particles comprised primarily of polymer having a Rockwell Hardness of less than R75.

17. The inkjet receiving media of claim 1, wherein the one or more multivalent metal salts comprises a cation selected from $Mg^{+2}$, $Ca^{+2}$, $Ba^{+2}$, $Zn^{+2}$, and $Al^{+3}$.

18. The inkjet receiving media of claim 1, wherein the one or more multivalent metal salts comprise $CaCl_2$, $Ca(CH_3CO_2)_2$, $MgCl_2$, $Mg(CH_3CO_2)_2$, $Ca(NO_3)_2$, or $Mg(NO_3)_2$, or hydrated versions of these salts.

* * * * *